US008149200B2

(12) United States Patent
Bu et al.

(10) Patent No.: US 8,149,200 B2
(45) Date of Patent: Apr. 3, 2012

(54) OVERDRIVE COMPENSATION/UPDATE INCLUDING GRAY TO VOLTAGE CONVERSION AND ADAPTABLE TO A DYNAMIC GAMMA GENERATOR

(75) Inventors: Lin-Kai Bu, Tainan (TW); Ling-Hsiu Huang, Tainan (TW); Shing-Chia Chen, Tainan (TW); Cheng-Jung Chen, Tainan (TW)

(73) Assignees: Himax Media Solutions, Inc., Tainan County (TW); Chimei Innolux Corporation, Miao-Li County (TW)

( * ) Notice: Subject to any disclaimer, the term of this patent is extended or adjusted under 35 U.S.C. 154(b) by 760 days.

(21) Appl. No.: 12/241,853

(22) Filed: Sep. 30, 2008

(65) Prior Publication Data

US 2010/0079362 A1 Apr. 1, 2010

(51) Int. Cl.
*G09G 3/36* (2006.01)

(52) U.S. Cl. ..... 345/89

(58) Field of Classification Search ..... 345/89
See application file for complete search history.

(56) References Cited

U.S. PATENT DOCUMENTS

| | | | | |
|---|---|---|---|---|
| 7,961,974 | B2 * | 6/2011 | Someya et al. | 382/274 |
| 2006/0017713 | A1 * | 1/2006 | Lee et al. | 345/204 |
| 2006/0132470 | A1 * | 6/2006 | Ho et al. | 345/204 |
| 2007/0279374 | A1 * | 12/2007 | Kimura et al. | 345/102 |
| 2008/0259088 | A1 * | 10/2008 | Eriguchi et al. | 345/531 |
| 2008/0279470 | A1 * | 11/2008 | Warmuth et al. | 382/255 |
| 2008/0284775 | A1 * | 11/2008 | Shen et al. | 345/214 |
| 2009/0251477 | A1 * | 10/2009 | Su et al. | 345/547 |

* cited by examiner

*Primary Examiner* — Chanh Nguyen
*Assistant Examiner* — John Kirkpatrick
(74) *Attorney, Agent, or Firm* — Stout, Uxa, Buyan & Mullins, LLP

(57) ABSTRACT

An overdrive system adaptable for a dynamic gamma generator is disclosed. A current gray-to-voltage converter (G/V) converts image data of a current frame from gray code to voltage level, and a previous gray-to-voltage converter (G/V) converts image data of a previous frame from gray code to voltage level. The voltage level of current frame and the voltage level of previous frame are inputted to an overdrive-voltage lookup table to retrieve an overdrive voltage level. Afterwards, a voltage-to-gray converter (V/G) converts the retrieved overdrive voltage level from voltage level back to gray code, resulting in an overdrive gray code. Accordingly, the overdrive gray code is compensated. Alternatively, the overdrive gray code is used to update an overdrive-gray-code lookup table, an output gray code of which is fed to the source driver.

23 Claims, 6 Drawing Sheets

OVERDRIVE COMPENSATION/UPDATE INCLUDING GRAY TO VOLTAGE CONVERSION AND ADAPTABLE TO A DYNAMIC GAMMA GENERATOR

BACKGROUND OF THE INVENTION

1. Field of the Invention

The present invention generally relates to overdrive and gamma systems, and more particularly to overdrive compensations/updates adaptable to a dynamic analog gamma generator.

2. Description of the Prior Art

Due to the liquid crystal capacitor of the liquid crystal molecules in a liquid crystal display (LCD), the liquid crystal molecules require a period of time to reach target orientations, and therefore the change of brightness of pixel usually lags behind the change of voltage difference employed between the pixel electrode and the common electrode. In order to increase the response time of the liquid crystal molecules, an overdrive (OD) technique is usually employed. A conventional overdrive system is typically implemented by an overdrive lookup table (OD LUT) as exemplified and simplified in the following Table 1.

TABLE 1

| | prev. | | | | |
|---|---|---|---|---|---|
| curr. | **0** | 8 | 16 | 24 | 32 |
| 0 | 0 | 0 | 0 | 0 | 0 |
| **8** | **13** | 8 | 5 | 4 | 2 |
| 16 | 29 | 21 | 16 | 9 | 7 |
| 24 | 56 | 38 | 32 | 24 | 18 |
| 32 | 86 | 60 | 53 | 40 | 32 |

The overdrive lookup table outputs an overdrive gray code to the source driver based on a previous-frame gray code and a current-frame gray code. In Table 1, the horizontal axis represents the previous-frame gray code, and the vertical axis represents the current-frame gray code. The retrieved gray code according to the previous-frame gray code and the current-frame gray code is the output gray code to be provided to the source driver. For example, if the previous-frame gray code is "0" and the current-frame gray code is "8", the code "13" is thus retrieved as the output gray code to the source driver.

The LCD typically includes a gamma reference voltage generator for the purpose of correcting the non-linear perception of human eyes. FIG. 1A shows a conventional gamma reference voltage generator (gamma generator, in short) which uses a voltage divider made of serially connected resistors 10. In modern image processing applications (such as contrast adjustment), the reference voltages generated by the gamma generator are dynamically adjusted. FIG. 1B shows, for example, an adaptive analog gamma reference voltage generator 12 disclosed in "Contrast Enhancement in Liquid Crystal Displays by Adaptive Modification of Analog Gamma Reference Voltages" by Seung-Woo Lee, IEICE Trans. Electron., Vol. E90-C, No. 11, pp. 2083-2087, November 2007, the disclosure of which is hereby incorporated by reference.

Whenever the reference voltage generated by the adaptive gamma generator 12 is adjusted from a curve A to another curve B as shown in FIG. 1C, the relationship between the output voltage level to the (data) gray code is accordingly changed. On the other hand, the relationship between the output gray code and the input gray code in the overdrive lookup table (Table 1), however, does not change accordingly. That is, the gray level in the overdrive lookup table has not adaptively adjusted as it should have in accordance with the adaptive adjustment in the adaptive gamma generator 12.

For the reason that the conventional overdrive lookup table could not adaptively keep up with the adaptive adjustment of the gamma generator, a need has arisen to propose a novel overdrive compensation or updating scheme adaptable to a dynamic or adaptive analog gamma generator.

SUMMARY OF THE INVENTION

In view of the foregoing, it is an object of the present invention to provide an overdrive compensation or update scheme adaptable to a dynamic gamma generator such that the overdrive system could adaptively keep up with the dynamic adjustment of the gamma generator.

According to one embodiment, a current gray-to-voltage converter (G/V) converts image data of a current frame from gray code to voltage level, and a previous gray-to-voltage converter (G/V) converts image data of a previous frame from gray code to voltage level. The voltage level of the current frame and the voltage level of the previous frame are inputted to an overdrive-voltage lookup table to retrieve an overdrive voltage level. Afterwards, a voltage-to-gray converter (V/G) converts the retrieved overdrive voltage level from voltage level back to gray code, resulting in an overdrive gray code. Accordingly, the overdrive gray code is compensated to provide proper overdrive gray code to the source driver no matter how the gamma generator changes. Alternatively, in another embodiment, whenever the gamma generator changes, the overdrive gray code is used to update an overdrive-gray-code lookup table, an output gray code of which is fed to overdrive the source driver.

DETAILED DESCRIPTION OF THE INVENTION

Figure 1A:
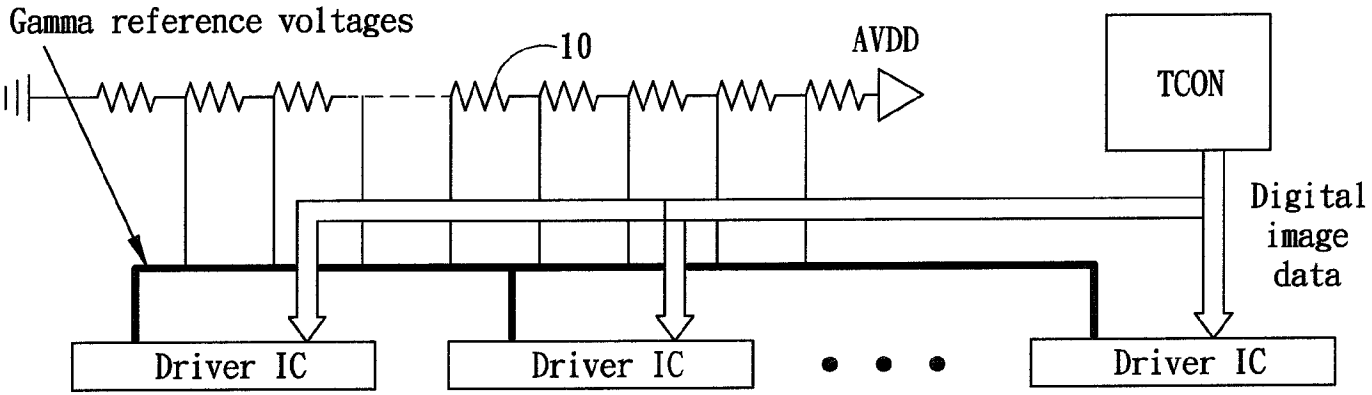
FIG. 1A(Prior Art)
FIG. 1A shows a conventional gamma reference voltage generator.
Figure 1B:
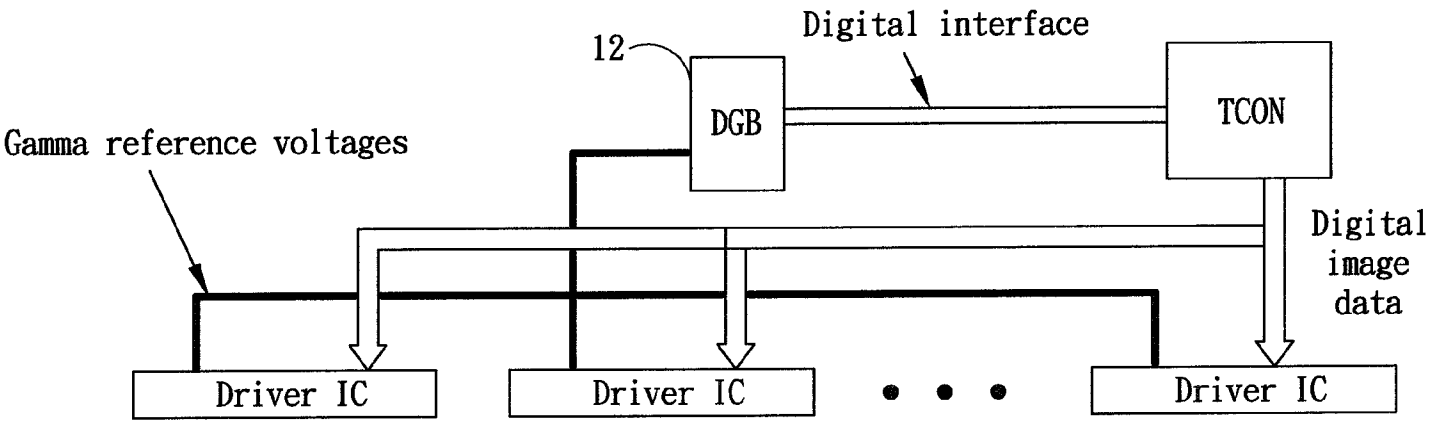
FIG. 1B(Prior Art)
FIG. 1B shows an adaptive analog gamma reference voltage generator.
Figure 1C:
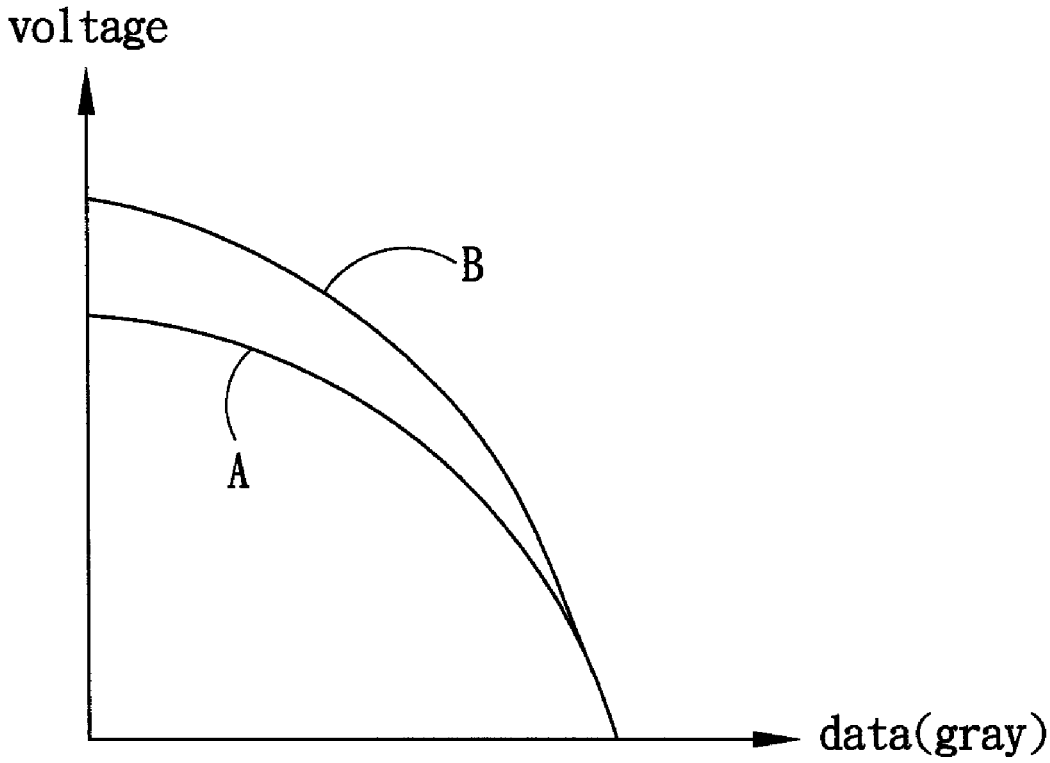
FIG. 1C(Prior Art)
FIG. 1C shows the relationship between the output voltage level to the (data) gray code when the adaptive gamma generator makes an adjustment.
Figure 2A:
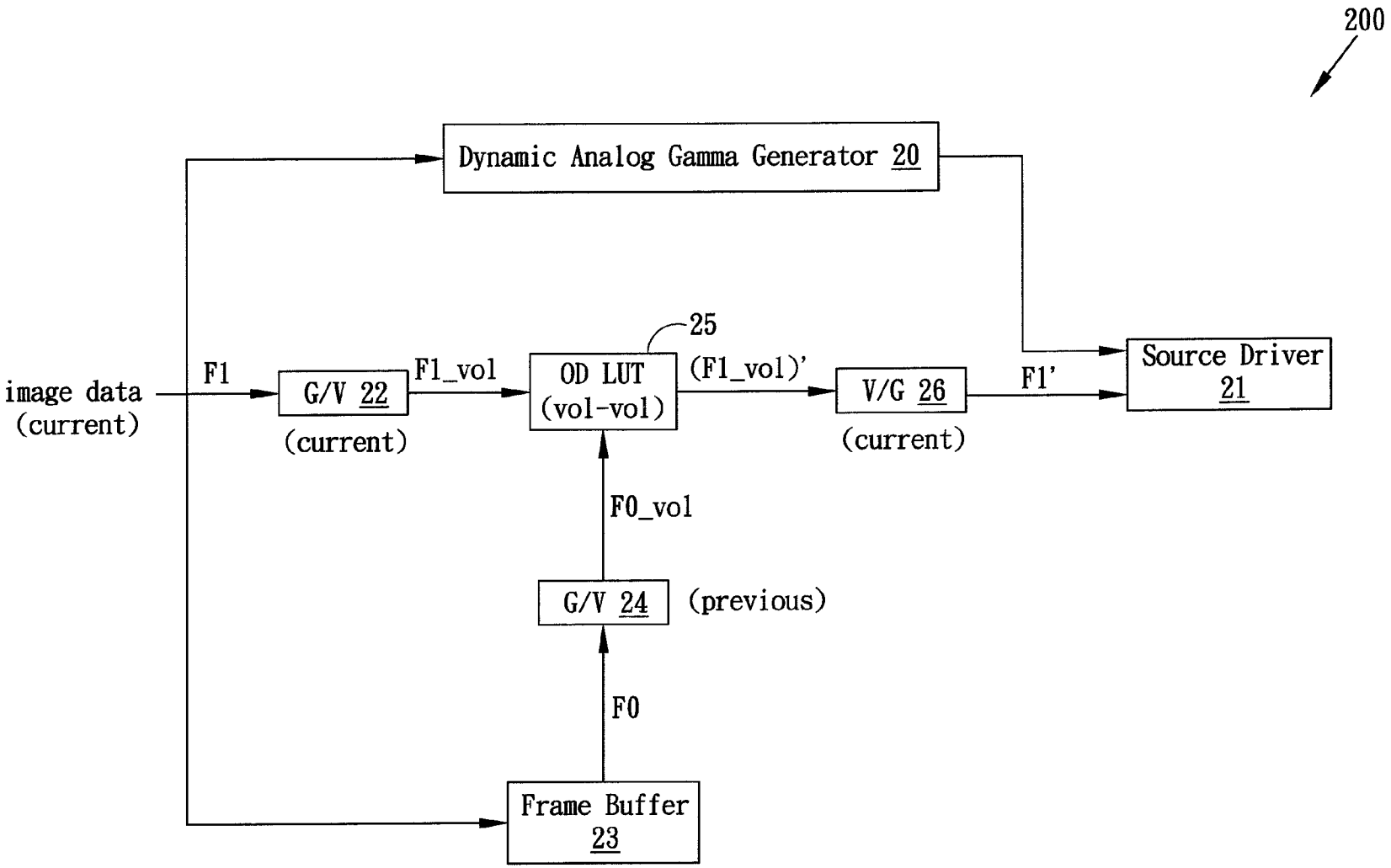
FIG. 2A illustrates an overdrive (OD) compensation system adaptable to a dynamic analog gamma generator according to one embodiment of the present invention.
Figure 2B:
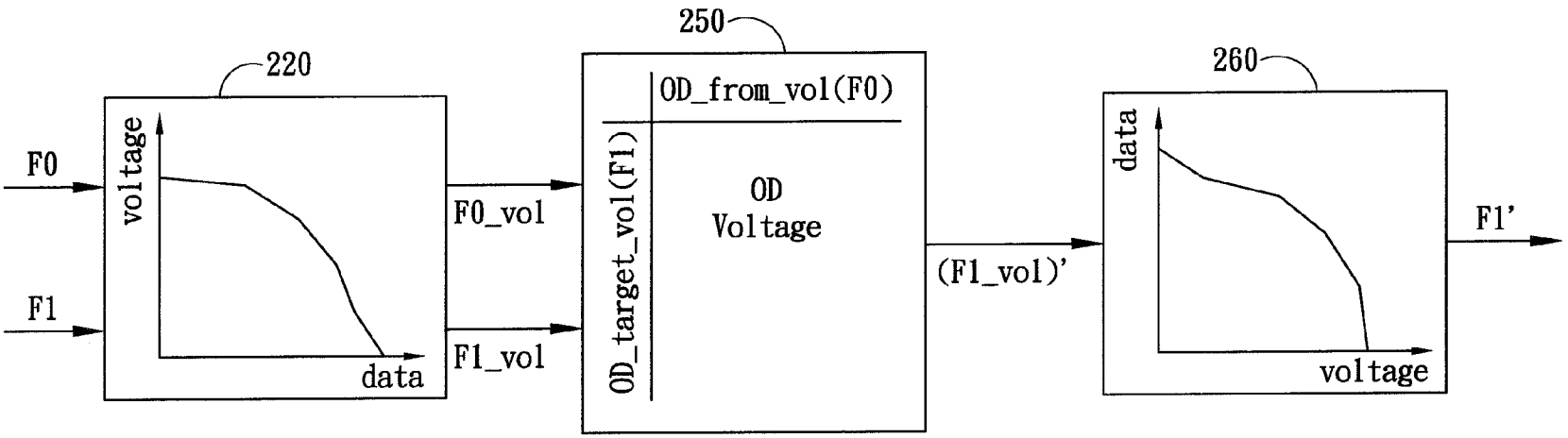
FIG. 2B illustrates a corresponding data/signal flow of FIG. 2A.

FIG. 2A illustrates an overdrive (OD) compensation system 200 adaptable to a dynamic (or adaptive) analog gamma generator (gamma generator, in short) 20 according to one embodiment of the present invention. FIG. 2B illustrates a corresponding data/signal flow of FIG. 2A. In the embodiment, the gamma generator 20 is generally capable of adaptively modifying the gamma reference voltages according to the image data distribution. The gamma generator 20 accordingly generates and provides gamma voltage to source driver 21.

Image data of the current frame is converted from gray code F1 to voltage level F1_vol by a gray-to-voltage converter (G/V) 22. The relationship between the voltage level F1_vol to the gray code F1 is exemplified by a transfer curve 220. The gray-to-voltage converter 22 may be implemented, for example, by a lookup table. On the other hand, image data of the previous frame is obtained from a frame buffer 23, and is converted from gray code F0 to voltage level F0_vol by another gray-to-voltage converter (G/V) 24. The relationship between the voltage level F0_vol and the gray code F0 is represented by the same transfer curve 220. The gray-to-voltage converter 24 may be also implemented, for example, by a lookup table.

The voltage level of current frame F1_vol and the voltage level of previous frame F0_vol are both inputted to an overdrive lookup table (OD LUT) 25, such that an overdrive voltage level (F1_vol)' can be retrieved from the overdrive lookup table 25 based on the voltage level of current frame F1_vol and the voltage level of previous frame F0_vol. In the embodiment, the overdrive lookup table 25 consists of a two-dimensional array 250, having a horizontal axis that represents the voltage level of previous frame, and a vertical axis that represents the voltage level of current frame. The retrieved value from the overdrive lookup table 25 based on the F1_vol and the F0_vol is thus the output voltage level (F1_vol)'. That is, if the voltage level in the previous frame is F0_vol and the target voltage level in the current frame is F1_vol, a voltage level (F1_vol)' is thus required to overdrive the LCD panel to improve the response time of the liquid crystal molecules. It is noted that the relationship expressed in the overdrive lookup table 25 is unique to a specific type of LCD panel, but may be distinct among different types of LCD panels. That is, the relationship expressed in the overdrive lookup table 25 is independent of change or adjustment made in the gamma generator 20 for the same type of LCD panels.

Subsequently, the output voltage level (F1_vol)' is further converted from voltage level (F1_vol)' back to gray code F1' by a voltage-to-gray converter (V/G) 26. The relationship between the gray code F1' and the voltage level (F1_vol)' is exemplified by a transfer curve 260, which is the inverse of the transfer curve 220. The voltage-to-gray converter 26 may be implemented, for example, by a lookup table. The gray-to-voltage converter 22, the gray-to-voltage converter 24, the overdrive lookup table 25 and the voltage-to-gray converter 26 may be implemented, for example, in a video processor. Afterwards, the converted gray code F1' is then fed to the source driver 21.

According to the embodiment described above, the overdrive gray code F1' is compensated by the system 200 and thus can provide proper overdrive gray code to the source driver 21 no matter how the gamma generator 20 changes.

Figure 3A:
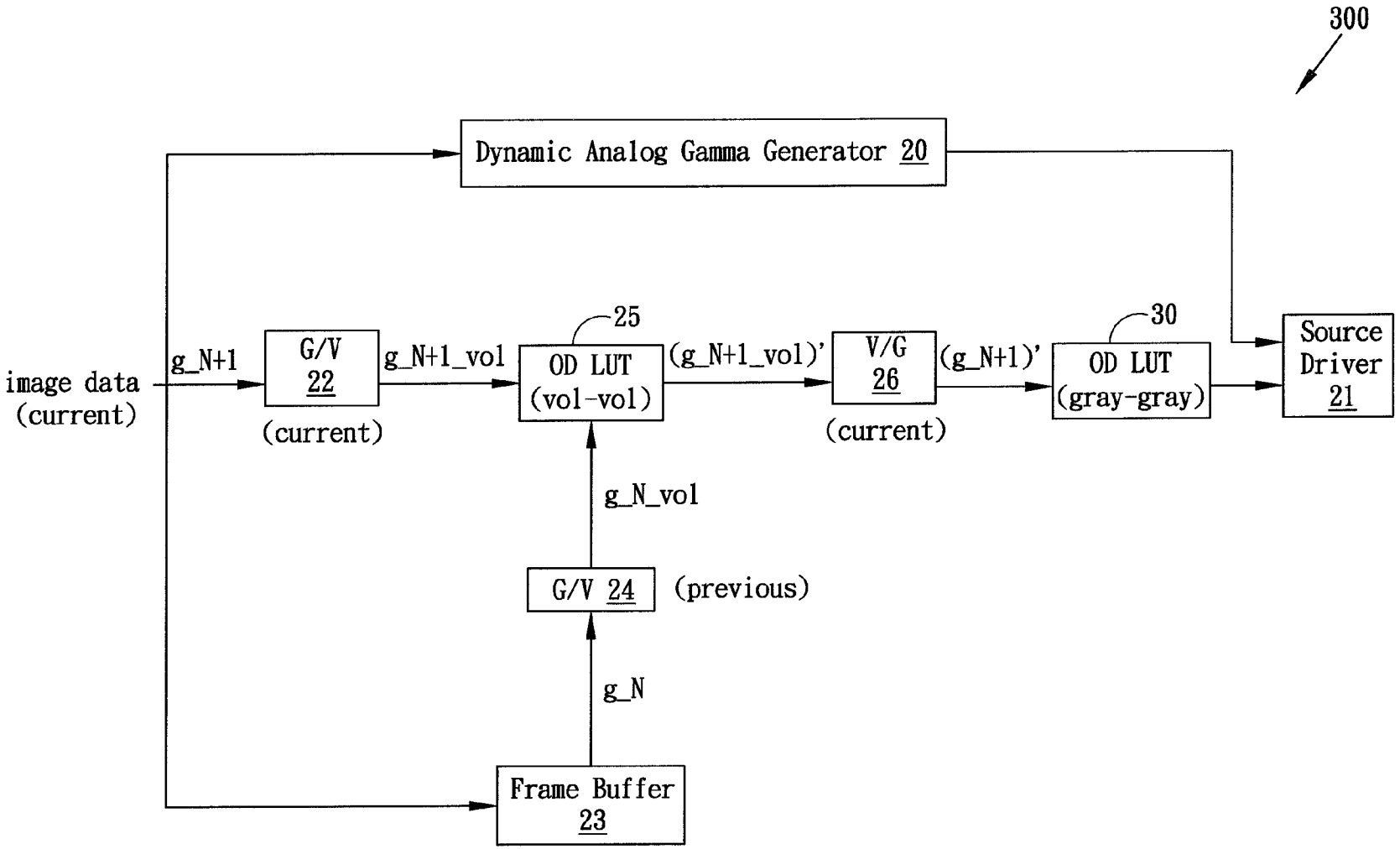
FIG. 3A illustrates an overdrive (OD) update system adaptable to a dynamic analog gamma generator according to another embodiment of the present invention.
Figure 3B:
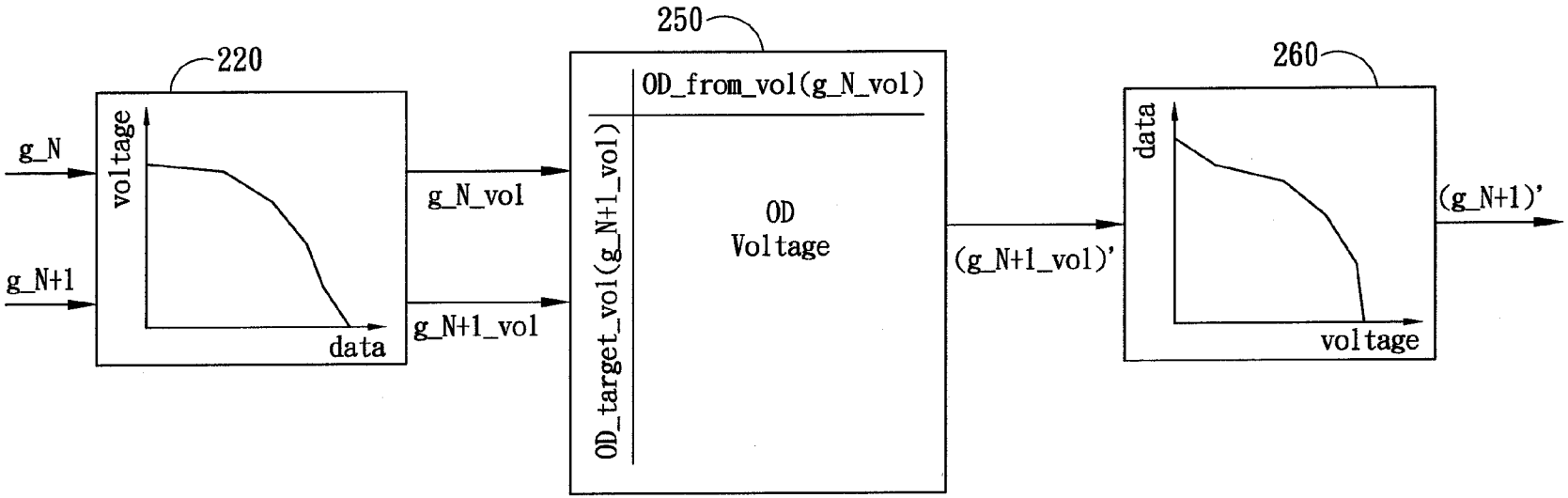
FIG. 3B illustrates a corresponding data/signal flow of FIG. 3A.

FIG. 3A illustrates an overdrive (OD) update system 300 adaptable to a dynamic (or adaptive) analog gamma generator (gamma generator, in short) 20 according to another embodiment of the present invention. FIG. 3B illustrates a corresponding data/signal flow of FIG. 3A. This embodiment utilizes some composing elements that have been used in the previous embodiment: the gray-to-voltage converter (G/V) 22, the frame buffer 23, the gray-to-voltage converter (G/V) 24, the overdrive lookup table (OD LUT) 25 and the voltage-to-gray converter 26.

In the operation, image data of current frame is converted from gray code g_N+1 to voltage level g_N+1_vol by the gray-to-voltage converter (G/V) 22 with the transfer curve 220. Image data of previous frame is obtained from a frame buffer 23, and is converted from gray code g_N to voltage level g_N_vol by another gray-to-voltage converter (G/V) 24 with the same transfer curve 220. The voltage level of current frame g_N+1_vol and the voltage level of previous frame g_N_vol are both inputted to the overdrive lookup table (OD LUT) 25, such that an overdrive voltage level (g_N+1_vol)' could be retrieved from the overdrive lookup table 25 based on the voltage level of current frame g_N+1_vol and the voltage level of previous frame g_N_vol. In the embodiment, the overdrive lookup table 25 consists of a two-dimensional array 250, having a horizontal axis representing the voltage level of previous frame, and a vertical axis representing the voltage level of current frame. The retrieved value from the overdrive lookup table 25 based on the g_N+1_vol and the g_N_vol is thus the output voltage level (g_N+1_vol)'. Subsequently, the output voltage level (g_N+1_vol)' is further converted from voltage level (g_N+1_vol)' to gray code (g_N+1)' by the voltage-to-gray converter (V/G) 26 with the transfer curve 260, which is the inverse of the transfer curve 220.

In the embodiment, the obtained gray code (g_N+1)' for each overdrive state is used to update another (conventional) overdrive lookup table 30, which is usually manufactured in the timing controller (Tcon) of the LCD panel. The overdrive lookup table 30 consists of a two-dimensional array such as that shown in the aforementioned Table 1, with a horizontal axis that represents the gray code of previous frame and a vertical axis that represents the gray code of current frame. The retrieved value from the overdrive lookup table 30 is the required overdrive gray, which is fed to the source driver 21. The updating of the overdrive lookup table 30 is carried out to all or some of the overdrive states in the overdrive lookup table 30, whenever the gamma generator 20 makes adjustment.

According to the embodiment described above, the overdrive gray codes in the overdrive lookup table 30 are updated by the system 300 and thus could provide proper overdrive gray code to the source driver 21 whenever the gamma generator 20 changes.

Although specific embodiments have been illustrated and described, it will be appreciated by those skilled in the art that various modifications may be made without departing from the scope of the present invention, which is intended to be limited solely by the appended claims.

What is claimed is:

1. An overdrive system including a dynamic gamma generator, comprising:

a current gray-to-voltage converter that converts image data of a current frame from gray code to voltage level;

a previous gray-to-voltage converter that converts image data of a previous frame from gray code to voltage level;

an overdrive-voltage lookup table from which an overdrive voltage level is retrieved based on the voltage level of the current gray-to-voltage converter and the voltage level of the previous gray-to-voltage converter; and a voltage-to-gray converter that converts the retrieved overdrive voltage level back to gray code, resulting in an overdrive gray code.

2. The system of claim 1, wherein, the current gray-to-voltage converter and the previous gray-to-voltage converter have one or more transfer functions that are the same.

3. The system of claim 1, further comprising a frame buffer for providing the image data of previous frame.

4. The system of claim 1, wherein the overdrive-voltage lookup table comprises a two-dimensional array, in which one axis represents the voltage level of previous frame, and another axis represents the voltage level of current frame, wherein retrieved value from the overdrive-voltage lookup table is the overdrive voltage level.

5. The system of claim 4, wherein the overdrive-voltage lookup table is independent of adjustment made in the dynamic gamma generator for a specific type of LCD panel.

6. The system of claim 1, wherein the voltage-to-gray converter has a transfer function inverse to that of the current gray-to-voltage converter and the previous gray-to-voltage converter.

7. The system of claim 1, wherein the converted overdrive gray code is fed to a source driver.

8. The system of claim 1, further comprising an overdrive-gray-code lookup table, in which one axis represents gray code of previous frame, and another axis represents gray code of current frame, wherein gray-code content of the overdrive-gray-code lookup table is updated by the converted overdrive gray code.

9. The system of claim 8, wherein the updating is carried out whenever the dynamic gamma generator makes adjustment.

10. An overdriving method including a dynamic gamma generator, comprising:

converting image data of a current frame from gray code to voltage level, resulting in a voltage level of current frame;

converting image data of a previous frame from gray code to voltage level, resulting in a voltage level of previous frame;

referencing an overdrive-voltage lookup table to retrieve an overdrive voltage level based on the voltage level of current frame and the voltage level of previous frame; and converting the retrieved overdrive voltage level back to gray code, resulting in an overdrive gray code.

11. The method of claim 10, wherein the conversion of the image data of current frame and the conversion of the image data of previous frame use one or more transfer functions that are the same.

12. The method of claim 10, further comprising a step of buffering the image data for providing the image data of previous frame.

13. The method of claim 10, wherein the overdrive-voltage lookup table comprises a two-dimensional array, in which one axis represents the voltage level of previous frame, and another axis represents the voltage level of current frame, wherein retrieved value from the overdrive-voltage lookup table is the overdrive voltage level.

14. The method of claim 13, wherein the overdrive-voltage lookup table is independent of adjustment made in the dynamic gamma generator for a specific type of LCD panel.

15. The method of claim 10, wherein the back conversion of the overdrive voltage level has a transfer function inverse to that of the conversion of the image data of current frame and the conversion of the image data of previous frame.

16. The method of claim 10, further comprising a step of feeding the converted overdrive gray code to a source driver.

17. The method of claim 10, further comprising a step of using the converted overdrive gray code to update an overdrive-gray-code lookup table, in which one axis represents gray code of previous frame, and another axis represents gray code of current frame.

18. The method of claim 17, wherein the updating is carried out whenever the dynamic gamma generator makes adjustment.

19. A display system comprising:

a video processor receiving image data and converting original gray codes of the received image data to overdrive gray codes;

a driving circuit that generates voltage levels corresponding to the overdrive gray codes according to a dynamic gamma curve; and a panel driven by the voltage levels from the driving circuit;

wherein the video processor comprises:

a current gray-to-voltage converter that converts the image data of a current frame from gray code to voltage level;

a previous gray-to-voltage converter that converts the image data of a previous frame from gray code to voltage level;

an overdrive-voltage lookup table from which an overdrive voltage level is retrieved based on the voltage level of the current gray-to-voltage converter and the voltage level of the previous gray-to-voltage converter; and a voltage-to-gray converter that converts the retrieved overdrive voltage level back to gray code, resulting in the overdrive gray code.

20. The display system of claim 19, wherein a transfer function of the current gray-to-voltage converter is the same as a transfer function of the previous gray-to-voltage converter.

21. The display system of claim 19, further comprising a frame buffer for providing the image data of previous frame.

22. The display system of claim 19, wherein, the voltage-to-gray converter has a transfer function inverse to that of the current gray-to-voltage converter and the previous gray-to-voltage converter.

23. The display system of claim 19, further comprising an overdrive-gray-code lookup table, in which one axis represents gray code of previous frame, and another axis represents gray code of current frame, wherein gray-code content of the overdrive-gray-code lookup table is updated by the converted overdrive gray code.

* * * * *